US008891798B1

(12) United States Patent
Laffon de Mazieres et al.

(10) Patent No.: US 8,891,798 B1
(45) Date of Patent: Nov. 18, 2014

(54) HEADPHONES WITH ASYMMETRIC COUPLING

(71) Applicant: Amazon Technologies, Inc., Reno, NV (US)

(72) Inventors: Emmanuel J M Laffon de Mazieres, Burlingame, CA (US); Adam K. Cybart, Morgan Hill, CA (US); Nicholas Ryan Gilmour, San Jose, CA (US); Marc Rene Walliser, San Francisco, CA (US); Chi Chiu Kwok, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 23 days.

(21) Appl. No.: 13/718,760

(22) Filed: Dec. 18, 2012

Related U.S. Application Data

(60) Provisional application No. 61/622,477, filed on Apr. 10, 2012.

(51) Int. Cl.
*H04R 25/00* (2006.01)

(52) U.S. Cl.
USPC ..... 381/374; 381/370

(58) Field of Classification Search
USPC ..... 381/370–371, 374–375, 379–381, 381/383–384
See application file for complete search history.

(56) References Cited

U.S. PATENT DOCUMENTS

| | | | | |
|---|---|---|---|---|
| 6,374,126 | B1 * | 4/2002 | MacDonald et al. | 381/375 |
| 7,436,974 | B2 * | 10/2008 | Harper | 381/374 |
| 7,693,295 | B2 * | 4/2010 | Harper | 381/374 |
| 8,189,843 | B2 * | 5/2012 | Harper | 381/374 |
| 8,249,286 | B2 * | 8/2012 | Nault | 381/380 |
| 2008/0317274 | A1 * | 12/2008 | Kim | 381/370 |

OTHER PUBLICATIONS

"Monster NCredible NErgy In-Ear Headphones (Old Version)", Monster NCredible NErgy In-Ear Headphones (Old Version): Electronics, http://reviews.cnet.com/headphones/monster-ncredible-nergy/4507-7877_7-35248362.html, 1 page.

* cited by examiner

*Primary Examiner* — Suhan Ni
(74) *Attorney, Agent, or Firm* — Novak Druce Connolly Bove + Quigg, LLP

(57) ABSTRACT

Headphones can be configured such that back surfaces of the speaker housings can be coupled to form a loop enabling users to wear the headphones around their necks when the speakers are not in use. In various embodiments, faces of the respective speaker housings may comprise asymmetrical, complementary surfaces. In such embodiments, the users can distinguish between the speakers intended to correspond with respective right and left stereo channels by tactile feel. In some embodiments, the interlocking of the housing structures can be achieved by magnetic force to maintain the coupling when the speakers are not in use but can be decoupled by the user without undue effort. In some embodiments, the speaker housings are configured to constrain the housings to a specific orientation when mated.

25 Claims, 6 Drawing Sheets

HEADPHONES WITH ASYMMETRIC COUPLING

CROSS REFERENCE TO RELATED APPLICATION

This application claims the benefit of U.S. Provisional Application No. 61/622,477, filed Apr. 10, 2012, which is hereby incorporated herein by reference.

BACKGROUND

Personal or portable electronic devices such as smart phones, tablets, portable media players, and e-book readers are now a staple of everyday life. At any one moment, a user can view a video streamed from the internet, dictate a shopping list to be played back at the grocery store, film a family vacation, play a digital song from a music library, or listen to a best-selling audiobook with one of today's personal electronic devices. It seems that the few limitations of these devices, such as external noise interfering with personal audio or potential intrusiveness upon others from sounds emanating from the devices, are imposed by the user's environment. Therefore to take full advantage of the portability and enhance the personal experiences provided by these devices, users will often pair their portable devices with headphones. Using such systems, users can enjoy the full panoply of features of their personal electronic devices in nearly any environment and at nearly any time.

Headphones come in several form factors, including over-ear or on-ear, which are placed outside of the ear, and in-ear, which are worn inside the ear. In-ear headphones can include ear buds, which may be located in the opening of the ear, or canal headphones, which are intended to be situated further inside the ear canal. In-ear headphones may be preferable to over-ear or on-ear headphones because in-ear headphones can be lighter and more compact. For some users, in-ear headphones can be much less obtrusive than over-ear or on-ear headphones. Conventional in-ear headphones, however, may be more easily misplaced and more likely to become damaged because of their relatively small size. Other users may prefer in-ear headphones because of their relative superior performance. In-ears, for example, may be better at blocking external noise than over-ears or on-ears because in-ears can form tighter seals by virtue of being positioned inside the ears. Users can listen to audio at lower volumes with in-ear headphones than over-ear or on-ear headphones if the in-ear headphones can provide a substantially tight seal not otherwise possible with over-ears or on-ears. Some users may not be able to immediately obtain the full performance benefits provided by conventional in-ear headphones, such as multi-channel stereo sound. Still others may prefer the fit of in-ear headphones over on-ear and over-ear headphones but there may not be a readily accessible and convenient location for conventional in-ear headphones when the speakers are not in use.

BRIEF DESCRIPTION OF THE DRAWINGS

Various embodiments in accordance with the present disclosure will be described with reference to the drawings, in which.

DETAILED DESCRIPTION

Figure 1A:
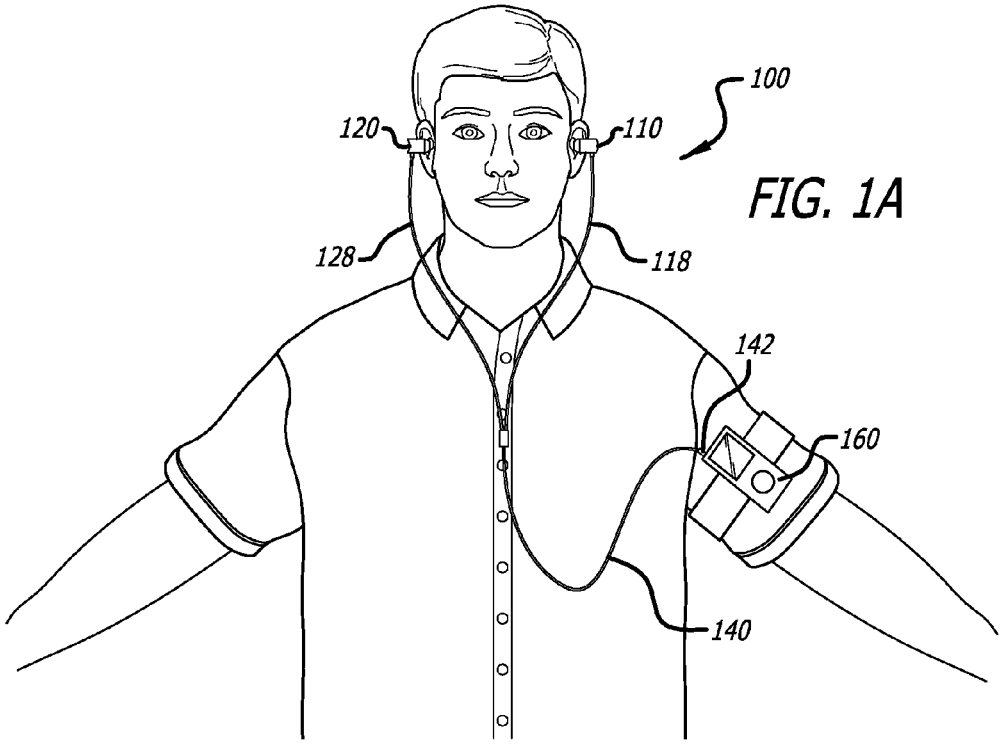
FIGS. 1A and 1B illustrate example uses of a set of in-ear headphones in accordance with various embodiments.

Systems and methods in accordance with various embodiments of the present disclosure may overcome one or more of the aforementioned and other deficiencies of conventional headphones and other personal audio output devices. In particular, various embodiments utilize in-ear headphones that can be coupled alongside surfaces of the speaker housing structures of the in-ear headphones. In some embodiments that include speaker cords attached to each of the earpieces, the speaker cords can form a loop or lanyard when the earpieces are interlocked such that the speaker cords can be worn around the user's neck when the speakers are not in use. When the headphones are situated in this manner, the headphones are immediately available to the user when the user desires to resume listening to audio. When the headphones are interlocked and placed in another location other than around the user's neck such as the user's pockets or backpack, the headphones may be less likely to become damaged. In addition, when the earpieces of various embodiments are mated to form a closed loop with the speaker cords, the speaker cords may be less likely to form knots.

In some embodiments, the coupling of what will be referred to herein as the "back" surfaces of the speaker housings can be achieved through the use of asymmetrical, complementary surfaces. It should be understood, however, that various surfaces or components can be used for interlocking personal audio devices within the scope of the various embodiments, and terms such as "back" are used for purposes of explanation and do not require a specific orientation unless otherwise stated. In one embodiment, one back surface of a speaker housing may be concave and the back surface of the other speaker housing is convex. Thus, the back surfaces are asymmetrical yet complementary with respect to one another. In other embodiments, other asymmetrical, complementary surfaces can be used. For example, one surface may include ridges and the complementary surface may include grooves. Another configuration may comprise one surface including protuberances and the complementary surface including dimples. Still other configurations may comprise patterns in relief and counter-relief or raised geometries and "sunken" geometries. Asymmetrical surfaces may enable complementary housings to guide each other into place when a user attempts to couple the respective housings. In addition, when asymmetrical surfaces are interlocked, they are less likely to shift or rotate and become decoupled as a result of user movement than conventional headphones. In some embodiments, the asymmetrical surfaces of the speaker housing structures can be configured to increase the amount of friction between the complementary surfaces than would be possible with conventional headphones.

In various embodiments, the asymmetrical back surfaces of earpieces can help the user to differentiate between a right speaker intended to correspond with a right stereo channel and a left speaker intended to correspond with a left stereo channel. Audio segments of media content are typically created for stereophonic or stereo sound. Generally, stereo sound can provide an illusion of directionality and depth by using two or more recorded audio tracks and enabling output to two or more separate audio channels. For example, multimedia content such as film, television shows, or video games can use multiple independent audio channels to produce certain sound effects that can provide users with a more immersive experience. Pure audio content such as music can also benefit from stereo sound by more closely emulating a concert hall performance than may be possible with monophonic or monaural sound. However, to appreciate these audio enhancements and achieve fidelity to what the content provider intended with respect to sound, the headphone user generally needs to correctly align right and left audio channels (respectively corresponding to right and left speakers) with the user's respective right and left ears. Thus, various embodiments may use "R" or "L" markings on the speaker housings to enable a user to make a distinction between speakers intended for respective right and left stereo channels. Other embodiments may use other markings, different color bands, or other indicators for users to properly associate speakers with respective right and left stereo channels.

Markings, however, can be rubbed off over a period of use. For other users, markings, color bands, or other visual cues capable of fitting onto in-ear headphones may be too small to be perceived. In certain circumstances, the user's current environment may limit visibility such that visual indicators cannot be seen or recognized. Consequently, a user may have to experiment before the speaker associated with the right stereo channel is properly aligned in the right ear and the speaker associated with the left stereo channel is aligned in the left ear. Speaker housings with asymmetrical back surfaces of various embodiments may enable a user to differentiate between right and left speakers for respective right and left stereo channels by tactile feel rather than being limited to visible cues.

In various embodiments, the coupling of the back surfaces of the speaker housings can be achieved by a magnetic connection between the complementary surfaces. There are many different configurations that can be used to provide sufficient magnetic force that will generally maintain the coupling of the earpieces but allow users to decouple without undue effort. In one embodiment, a single block magnet can be arranged inside each of the speaker housings towards the back surface and across each face of the back surface. The polarity and orientation of the magnets may be selected to mate the complementary surfaces in only one configuration. For example, the magnet of the left speaker structure might have one polarity (e.g., N) facing the back surface, while the magnet of the right speaker structure can be oppositely configured (e.g., S) such that the back surfaces of the speaker housings magnetically couple in a preferred orientation. In addition, alternative embodiments use various types of magnets, including permanent magnets (e.g., Neodymium Iron Boron, Samarium Cobalt, Iron Oxide and Barium, Iron Oxide and Strontium, Aluminum Nickel Cobalt, ceramic, etc.), temporary magnets, electromagnets, superconductors, etc.

Various other systems, features, and uses are presented below with respect to the various embodiments.

Figure 1B:
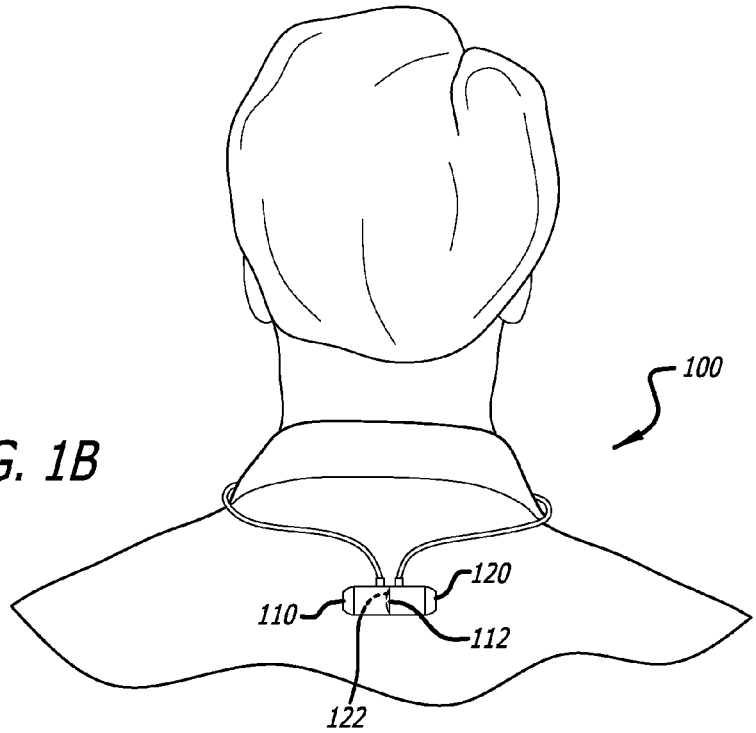

FIG. 1A and FIG. 1B illustrate example uses of a set of in-ear headphones in accordance with various embodiments. FIG. 1A depicts a front perspective of a user operating in-ear headphones 100 as a speaker in left housing structure 110 (from the perspective of the user) and a speaker in right housing structure 120 are in operation. Each of the housing structures or earpieces 110 and 120 have a front surface (not shown) that can be placed anywhere from the opening of the ear to inside the ear canal, which can depend in part on the dimensions of the earpieces and on a user's physical characteristics and personal preferences. In various embodiments, each of the earpieces 110 and 120 can respectively connect to a left speaker cord 118 and a right speaker cord 128. Left speaker cord 118 and right speaker cord 120 can, in turn, connect to a jack cord 140 (although in alternative embodiments the speaker cords may connect directly to a jack). At the other end, jack cord 140 is connected to a jack (not shown) that can connect the headphones to an electronic device 160. In various embodiments, headphones can include a jack cord casing 142 wrapped around the end of the jack cord 140 that is connected to an audio jack. Jack cord casing 142 can be made from a suitable thermoplastic elastomer (TPE) that can limit strain on the jack cord when the headphones are connected to an electronic device. In various embodiments, left speaker cord 118, right speaker cord 128, and jack cord 142 can each comprise a material having anti-tangling qualities with a matte finish and a soft feel.

In the embodiment of FIG. 1A and FIG. 1B, the jack is a four-conductor 3.5 mm (approximately ⅛") audio jack comprising a tip for an input signal for the left stereo channel, a first ring for an input signal for the right stereo channel, a second ring for a return signal for a controller (which will be discussed in detail in FIG. 2 below), and a sleeve for the microphone signal. An audio jack with such a configuration can sometimes be referred to as a TRRS (tip, ring, ring, sleeve) connector, and can be configured to rearrange which signals are applied to each conductor. In alternative embodiments, a 2.5 mm (approximately 3/32") audio jack or a ¼" audio jack can be used. In other embodiments, such as those without a microphone, a TRS (tip, ring, sleeve) connector can be used. In yet another embodiment, an RCA connector can be used. In still other embodiments, different size jacks and different combinations and configurations of conductors can be used.

FIG. 1B demonstrates one possible use case for various embodiments when the speakers of speaker housings 110 and 120 are not intended to be in operation. For example, in the embodiment of FIG. 1B, left back surface 112 of earpiece 110 can form a coupling with right back surface 122 of earpiece 120 such that left speaker cord 118 and right speaker cord 128 form a lanyard that the user can wear around his neck. As the user moves about, earpieces 110 and 120 generally remain connected. When the user elects to resume use of the speakers, they can be readily re-inserted into the user's ears by decoupling housing structures 110 and 120 with undue effort. A discussion of various ways the coupling can be achieved will be presented below.

Figure 2:
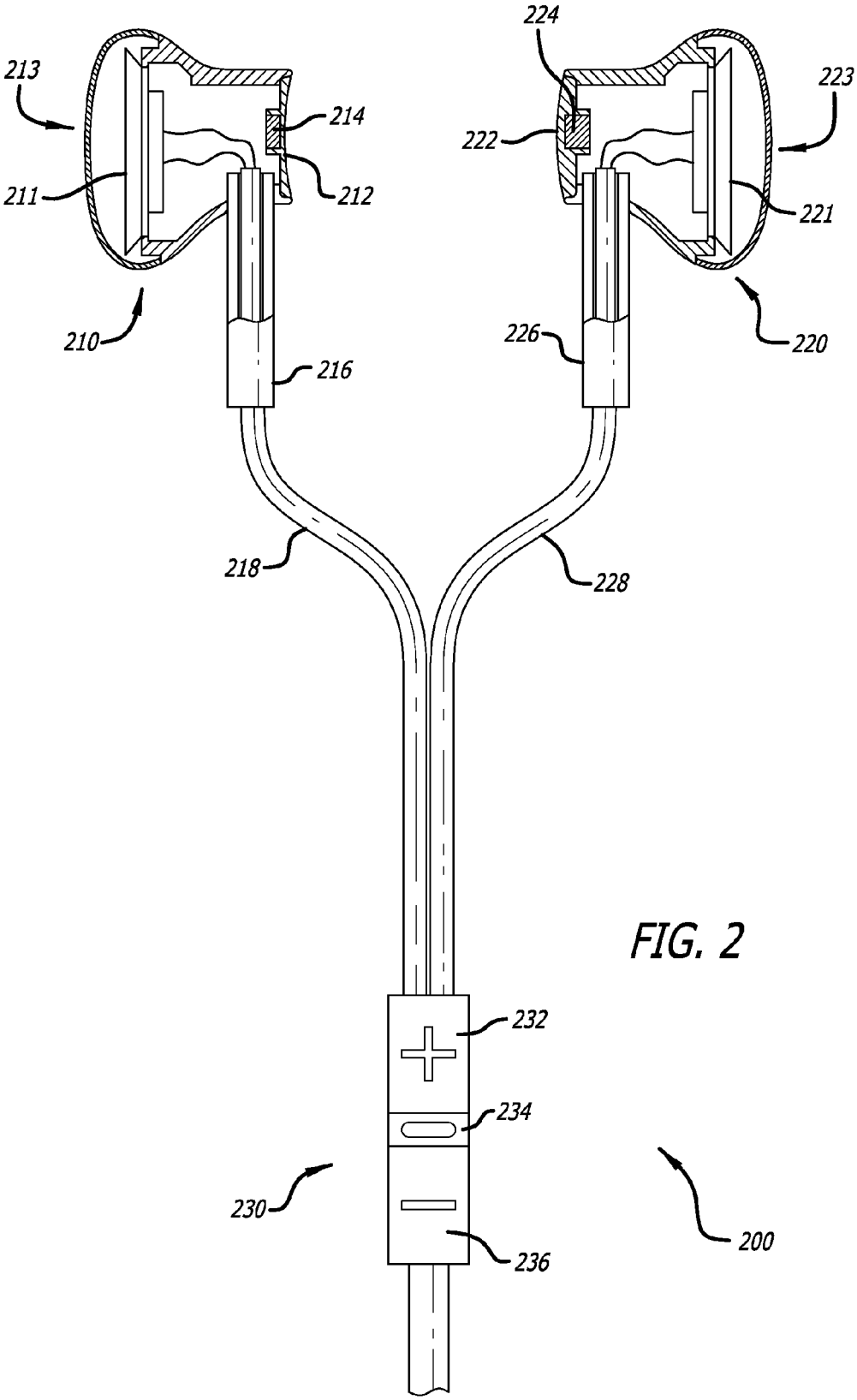
FIG. 2 illustrates an example of a set of ear buds in accordance with one embodiment.

FIG. 2 illustrates an example of a set of ear buds 200 in accordance with one embodiment. In various embodiments, the left speaker housing structure 210 and right speaker housing structure 220 are designed to have asymmetric, complementary back surfaces. In one embodiment, the back surface of the right housing 222 is convex, and the back surface of the left housing 212 is concave. The respective back surfaces of this embodiment are configured asymmetrically so that a user may be able to immediately discern a right housing structure from a left housing structure by tactile feel. In various embodiments, the respective back surfaces are also designed to be complementary to enable the two surfaces to generally mate with each other and to minimize the footprint of the speaker housings when interlocked. In one embodiment, the housing structures 210 and 220 are composed of Styron™ Polycarbonate 8600-10. Various different, but complementary, asymmetric surface combinations can be used, such as those illustrated in FIG. 5A-5D, discussed in detail below.

In various embodiments, the speaker housing structures can be interlocked using a magnetic connection. Suitable magnets are generally selected to provide a sufficiently strong connection to maintain a coupling of the two earpieces when the speakers are not in use but still allow for decoupling without excessive effort when a user desires to resume use of the speakers. The magnets are arranged based upon the configuration of the speaker housing structures and the location of the speakers or drivers (also known as transducers) inside the structures. As can be appreciated by those of ordinary skill in the art, headphones typically incorporate dynamic drivers and/or balanced armature drivers (although electrostatic, electret, air motion transformer, piezoelectric film, ribbon planar magnetic, magnetostriction, and plasma-ionization drivers have also been known to be used as speaker drivers). Both dynamic and balanced armature drivers include internal permanent magnets or stationary magnets to generate a static magnetic field that interact with the respective voice coil or armature of the drivers. Introducing an additional permanent magnet inside a speaker housing may cause interference with the operation of the dynamic or balanced armature drivers. Another design consideration that can also be appreciated is that the earpieces must be small enough to be capable of fitting inside the ear and not stick out conspicuously outside the ear. Therefore, for various embodiments using additional permanent magnets for interlocking, maintaining a minimum distance between the additional permanent magnets and the drivers is counterbalanced with the need to keep the housing structure compact. In certain embodiments using additional permanent magnets, the magnets can be arranged to allow for only one orientation for coupling. For example, the magnets can be oriented so that the speaker cords are aligned when the earpieces are mated. Such a configuration can limit or prevent altogether the housing structures from pivoting, rotating, or shifting during movement or being situated in an askew configuration when the headphones are used as a lanyard, which could be physically uncomfortable or otherwise undesirable to some users.

In some embodiments, the headphones can be configured as a switch to provide one or more control signals to a connected electronic device when the earpieces are coupled or decoupled. For example, each time two earpieces of such embodiments are coupled, a control signal can be sent to power down or otherwise modify the power state of the connected electronic device (e.g., from an active mode to a sleep mode or from a normal mode to a vibrate mode) or power down or modify the power state of certain components of the device, such as audio components (including both hardware and software components). For instance, an audio codec such as audio codec element 708 in FIG. 7 or music software can be shut down or transitioned to a passive state for power-saving purposes since the speakers may not intended to be in operation when the earpieces are coupled. In addition, or alternatively, when the two earpieces initially become decoupled, the electronic device or components of the electronic device can be powered on or the power state of the device and/or its components can otherwise be modified.

As shown in FIG. 2, left speaker housing structure 210 includes a permanent magnet 214 that substantially abuts the back surface 212 and a driver 211 that is located towards the front surface 213. Right housing 220 includes a corresponding permanent magnet 224 that substantially abuts the back surface 222 of right housing 220. The polarities of magnets 214 and 224 are configured to be complementary, i.e., the front face of magnet 214 is one polarity and the front face of magnet 224 is the opposite polarity. Right housing 220 also includes a right driver 221 that is located towards the front surface 223 of housing 220. In various embodiments of ear buds, each of the front surfaces 213 and 223 include a mesh cap to protect the respective drivers 211 and 221 from dust and debris. In some embodiments, drivers 211 and 221 can be selected from one of AAC Technologies Holdings Inc. WHS-300, WHS-400, or WHS-600 or Foster Electric Co., Ltd. 492854, each being a dynamic driver. Although the embodiment of FIG. 2 uses one dynamic driver, it will be appreciated that various combinations of a dynamic driver and one or more armature drivers can be used in alternative embodiments. For example, in various embodiments, a dynamic driver is combined with one or more balanced armature drivers. In another embodiment, two balanced armature drivers are used. In yet another embodiment, discussed further below in FIG. 4, three balanced armature drivers are used.

In the embodiment of FIG. 2, permanent magnets 214 and 224 are composed of an alloy of Neodymium, Iron, and Boron ($Nd_2Fe_{14}B$) with an N48 grade. In one embodiment, left permanent magnet 214 is configured to be a horizontal block having dimensions of 4.0 mm×2.0 mm×0.9 mm and positioned approximately across the center of the back surface 214, and perpendicular to speaker cord casing 216. In one embodiment, corresponding right permanent magnet 224 is also configured to be a horizontal block having dimensions of 4.0 mm×2.0 mm×1.8 mm and positioned approximately across the center of back surface 224 and perpendicular to speaker cord casing 226. In one embodiment, right permanent magnet 224 is twice as thick as left permanent magnet 214 because there is more space inside the convex back surface of right housing 222. In one embodiment, when left permanent magnet 214 and right permanent magnet 224 are interlocked, a distance of 0.85 mm separates the two magnets. In one embodiment, a force of approximately 0.8 N can be used to separate left permanent magnet 214 and right permanent magnet 224 when attached together. In one embodiment, each of the permanent magnets 214 and 224 are a distance of 7.0 mm from their respective drivers 211 and 221.

In various embodiments, headphones, like ear buds 200, can also include speaker cord casings 216 and 226. In some embodiments, speaker cord casings 216 and 226 are made from a suitable thermoplastic elastomer (TPE) that can limit strain on the speaker cords 216 and 226 at the junction with the respective earpieces 210 and 220. In some embodiments, the dimensions and positions of left permanent magnet 214 and right permanent 224 limit the earpieces to one orientation when attached together. This can enable left speaker cord casing 216 and left speaker cord 218 to remain aligned with right speaker cord casing 226 and right speaker cord 228 when the speaker housings 210 and 220 are mated. It should be appreciated that alternate embodiments may have numerous variations from that described above. For example, other numbers of magnets, materials, grades, shapes, dimensions, and configurations can be used as well within the scope of the various embodiments relying on a magnetic connection to couple the speaker housings.

For example, in various embodiments, the material of the magnets can be selected among an alloy of sintered Neodymium, Iron, and Boron (e.g., $Nd_2Fe_{14}B$) with grades ranging from 28 to 52; an alloy of bonded Neodymium, Iron, and Boron with grades ranging from 2 to 13; an alloy of Samarium Cobalt (e.g., $Sm_1Co_5$ or $Sm_2Co_{17}$) with grades ranging from 16 to 24; a composite of iron oxide and Barium or Strontium (e.g., $BaFe_2O_3$ or $SrFe_2O_3$) with grades ranging from 1 to 11; and an alloy of cast, sintered, or bonded Aluminum, Nickel, and Cobalt with grades ranging from 2 to 9.

As another example, in various embodiments, the magnets can be selected according to different magnet dimensions, number of magnets, positions, and shapes. The shapes can include discs, cubes, rods, spheres, wedges, cylinders, arcs, rings, or blocks. In one example, each earpiece can include two block magnets arranged with one block magnet positioned towards the top of the back surface of a speaker housing and the other block magnet positioned towards the bottom of the back surface. In another embodiment, four quarter-wedge magnets can be arranged to substantially form a circle (if the edge opposite of the point of the wedge is arc-like) or diamond or square (if the edge of the opposite of the point of the wedge is straight). Each of these configurations can be further varied by selecting particular combinations of polarities of the magnets with respect to the face of the back surface of the housing structure. For example, in the embodiment using two block magnets, the top magnet of the left earpiece might have one polarity (e.g., N) facing the back surface of the earpiece, while the bottom magnet of the left earpiece has the opposite polarity (e.g., S) facing the back surface of the earpiece. The magnets of the right earpiece can be oppositely configured (e.g., top S, and bottom N) so that the two earpieces magnetically couple in a preferred orientation.

In yet another example, a right housing structure can have one or more magnets, while the left housing has only a ferromagnetic material to which the magnet(s) of the right housing will be attracted. In other words, in this example, the left earpiece does not have any magnet for use in coupling the two earpieces. In still another embodiment relying on magnetic coupling, no additional magnets are included in either speaker housings. Instead, the speakers or drivers are customized to provide the magnetic connection for the speaker housings. As discussed previously, the drivers typically used by headphones comprise dynamic drivers or balanced armature drivers. Dynamic drivers can include a permanent magnet or stationary magnet located behind a flexible cone or diaphragm. An electromagnetic voice coil can also be attached to the diaphragm and interposed between the diaphragm and stationary magnet. Sound may be produced by rapidly alternating the polarities of the electromagnet coil, which will alternately be attracted to or repulsed by the stationary magnet and in turn cause the diaphragm to vibrate. Balanced armature drivers can also include a stationary magnet, a diaphragm, and a voice coil. Balanced armature drivers can also include an armature and a drive rod. The armature can be interposed between two opposing polarities of the stationary magnet and the voice coil can be positioned parallel to the opposing polarities of the stationary magnet and normal to the armature. The armature can be attached to the drive rod and the drive rod can be attached to the diaphragm at the other end. An audio current can run through the voice coil to cause the armature to alternate between the polarities of the stationary magnet, which will in turn cause the drive rod to move and consequently the diaphragm to vibrate. In one embodiment, the stationary magnets of the drivers can be configured to provide the magnetic connection between the speaker housings (e.g., with stronger and/or larger stationary magnets) and the voice coil and input audio current (and armature and driver in the case of a balanced armature driver) can be modified based upon the properties of the new stationary magnets as would be capable of one of ordinary skill in the art. Such a configuration may also enable the speaker housing to be more compact than various embodiments using additional magnets to achieve a magnetic connection. Such a configuration, however, may not be as advantageous as using standard component drivers because of cost and driver quality issues.

In various embodiments, in-ear headphones can also include a third housing structure. In some embodiments, the third housing structure can incorporate various control elements to control an electronic device to which the headphones are connected. Control element(s) can include power switches; functionality switches; control functionality switches; controls for volume; controls for playing, rewinding, forwarding, pausing, or stopping content; controls for skipping a segment of content or an item of content; controls for returning to a segment of content or returning to a previous item of content, etc. In some embodiments, the control elements may each comprise a button or dome assembly. The buttons can be configured such that depressing a single button corresponds to a particular control, such as turning up a volume, and depressing two or more buttons simultaneously can provide a different control, such as fast forwarding or skipping content. In other embodiments, a single control element comprising a touch array or surface can be incorporated to receive user gestures to control a connected electronic device. Such a touch surface can be single touch or multi-touch, and can include capacitive (including surface capacitive or projected capacitive), resistive, optical wave (including infrared), force-sensing, or other hybrid touch mechanisms known to those of ordinary skill in the art (such as interpolating force-sensitive resistance (IFSR)).

In some embodiments, the headphones can also include one or more microphones. A system incorporating a microphone can sometimes be referred to as a headset. In the embodiments incorporating one or more microphones, one microphone may be located within the third housing structure and is preferably positioned close enough to the user's mouth that the microphone can pick up the sound of the user's voice. Additional microphones may be located in each of the speaker housings and can be used for applications such as noise cancellation, noise isolation, and/or robust speech recognition. In other embodiments, the third housing structure can include the components for features such as noise cancellation, noise isolation, and/or Bluetooth or other wireless technology (in embodiments with and without a jack) that may not fit into the speaker housings or may be more desirably located in the third housing.

The embodiment of FIG. 2 includes a third housing structure 230 at a union of left speaker cord 218 and right speaker cord 228. Housing structure 230 includes a first control element 232, a second control element 234, and a third control element 236. First control element 232 enables a user to incrementally turn up the volume of an audio output device, such as the electronic device 160 in FIG. 1A or the electronic device 500 in FIG. 5, that is connected to ear buds 200. A second control element 234 enables the user to power on or off the audio output device attached to ear buds 200. A third control element 236 enables the user to incrementally turn down the volume of an audio output device attached to headphones 200. Although not shown, the embodiment of FIG. 2 also includes a microphone port on the bottom side of housing structure 230. In various embodiments, each of the control elements 232, 234, and 236 can provide a desirable tactile feel. The control elements 232, 234, and 236 can be designed in a way to maximize the stiffness and natural frequency of the underlying substrate, keypad flex, and dome or button assembly. In one embodiment, the Dome Snap (Click) Ratio is approximately 38%. In one embodiment, the Dome Force is approximately 160 grams. In one embodiment, the Dome Life is greater than 500K cycles. In one embodiment, the Dome to Dome Tolerance is ±0.1 mm, with auto placement preferred in various embodiments. In one embodiment, the Metal Snap Dome Switches measure a minimum of 4.0 mm in diameter. In various embodiments, the domes have actuators or dimples. In various embodiments, the buttons 232, 234, and 236 and the housing 230 are designed to prevent dust and water ingress and to minimize ElectroStatic Discharge (ESD) risk. In one embodiment, the material for the housing 230 comprises Styron™ Polycarbonate 8600-10. Although the embodiment of FIG. 2 describes three dome or button assemblies for control elements 232, 234, and 236, it will be appreciated that alternative embodiments are not so limited. For example, various embodiments use a capacitive touch array that enables predetermined or user-specified touch gestures to control an audio device to which headphones 200 are connected.

In other embodiments, various types of magnetic shielding devices and materials (e.g., mu metal, ferromagnetic materials) can be included to help insulate the drivers from the additional magnets used to couple the speaker housing structures together. Although certain specifications have been provided for the various features of the embodiment of FIG. 2, it will be appreciated that the present disclosure is not limited to the specifications of the embodiment of FIG. 2, and numerous variations can be used and not deviate from the scope or spirit of the invention.

Figure 3:
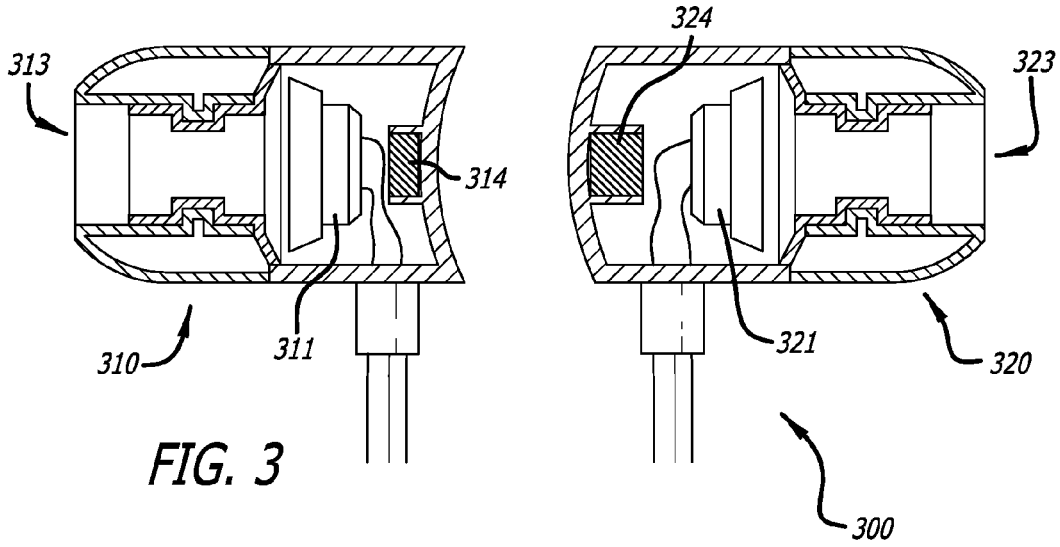
FIG. 3 illustrates an example of earpieces of a set of canal headphones in accordance with one embodiment.

FIG. 3 illustrates an example of a set of canal headphones 300 in accordance with one embodiment. The embodiment of FIG. 3 includes a left housing structure 310 with a left speaker driver 311 and left magnet configuration 314 and a right housing structure 320 with a right speaker 321 and right magnet configuration 324. In some embodiments, each of the left front surface 313 of the left earpiece 310 and the right front surface 323 of the right earpiece 320 can include a silicone ear tip that can be removed and replaced. Various embodiments of canal headphones can be paired with ear tips as ear tips can increase user comfort and may improve the seal between the ear and a canal earpiece. There are several different types of ear tips, including soft plastic ear tips which can be composed of silicone or polyvinyl chloride (PVC), foam ear tips, and custom-molded ear tips that can comprise hard acrylic, soft silicone, or a combination of both. Soft plastic ear tips can be universal fit or size-dependent fit (e.g., small, medium, and large). Foam tips can also be universal fit or size-dependent fit. Foam tips may often be unwashable and may require replacement after a short period of use of such as a few weeks or a few months. Other foam tips may be designed for user cleaning. Custom-mold tips can often be provided with a customized In-Ear Monitor System (IEMS) intended for audio professionals where the ear tips are fabricated along with the other components of the canal headphones. Custom-mold tips, however, can also be provided for standard or universal canal headphones designed for universal fit or size-dependent fit ear tips by certain third party vendors.

Figure 4:
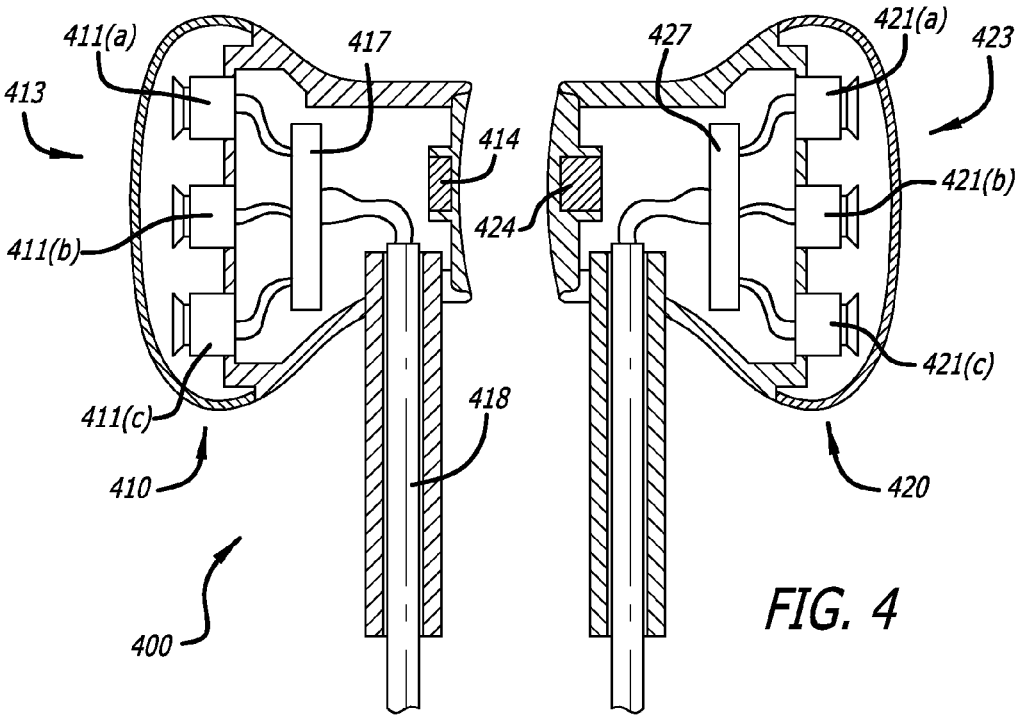
FIG. 4 illustrates an example of earpieces of a set of ear buds in accordance with one embodiment.

FIG. 4 illustrates an example of a set of ear buds 400 in accordance with one embodiment. The embodiment of FIG. 4 includes a left housing structure 410 and a right housing structure 420. Also shown in the embodiment of FIG. 4 are speaker drivers 411(*a*), 411(*b*), and 411(*c*), and crossover network 417 located within left housing 410. Right housing 420 correspondingly has speaker drivers 421(*a*), 421(*b*), and 421(*c*), and crossover network 427 that operate substantially similarly to the driver configuration of left housing 410, and thus, discussion of the operation of the driver system of the left housing may be equally applicable to the driver system of the right housing. Although the respective driver systems of left earpiece 410 and right earpiece 420 are similar in the embodiment of FIG. 4, it will be appreciated that left and right driver systems of various embodiment may comprise independent audio channels and the left and right driver systems are not necessarily symmetrical in all embodiments.

Each of the speaker drivers of the embodiment of FIG. 4 comprise balanced armature drivers. Driver 411(*a*) is configured for low frequency sounds and can be referred to as a woofer, driver 411(*b*) is associated with midrange frequencies and can be referred to as a midrange, and driver 411(*c*) corresponds to high frequency sounds and can be referred to as a tweeter. Although woofer driver 411(*a*), midrange driver 411(*b*), tweeter driver 411(*c*), and crossover network 417 are illustrated as four different elements in FIG. 4, it will be appreciated by those of ordinary skill in the art that the drivers and crossover network of an audio driver system can comprise one or more standard or custom components. In addition, an audio driver system could operate equally well having fewer or a greater number of components than are illustrated in FIG. 4. Thus, the depiction of the audio driver system in left earpiece 410 in FIG. 4 should be taken as being illustrative in nature and not limiting to the scope of the disclosure. For example, in other embodiments using different combinations of drivers, the audio frequency spectrum can be distributed according to the number and type of drivers of the system. In one example comprising a combination of a dynamic driver and a balanced armature driver, the dynamic driver handles low-frequency and midrange audio and the balanced armature driver is used for high-frequency sounds. In another example consisting of two balanced armature drivers, one driver is responsible for one half of the frequency spectrum and the other driver is responsible for the other half of the spectrum. It will be appreciated that numerous combinations of dynamic and balanced armature drivers can be configured in various embodiments.

In an operation of the embodiment of FIG. 4, the left speaker system initially receives an audio signal from left speaker cord 418 at crossover network 417. In the embodiment of FIG. 4, crossover network 417 is a passive three-way crossover, i.e., uses passive filters comprising combinations of resistors, inductors, and capacitors. In alternative embodiments, the crossover network can comprise active filters using active devices such as op-amps. The crossover 417 of the embodiment of FIG. 4 is a three-way crossover, but it will be appreciated by those of ordinary skill in the art that a crossover network can be n-way depending on the characteristics of the drivers. In some embodiments, crossovers can be digital and use a digital signal processing (DSP) chip or other microprocessor to emulate analog filters. After receiving an input audio signal, crossover network 417 splits the audio signal according to low frequencies, midrange frequencies, and high frequencies, and routes them to the woofer driver 411(*a*), midrange driver 411(*b*), and tweeter driver 411(*c*), respectively. Sound is delivered to the user through the front surface 413. In the embodiment of FIG. 4, drivers 411(*a*), 411(*b*), and 411(*c*) are located towards the front surface 413 and magnet 414 is located towards the back surface of earpiece 410. Likewise, in earpiece 420, drivers 421(*a*), 421(*b*), and 421(*c*) are positioned towards the front surface 423 and magnet 424 is located along the back surface.

Although FIG. 3 and FIG. 4 are not drawn to scale, it will be appreciated that balanced armature drivers are typically smaller than dynamic drivers, providing various embodiments using balanced armature drivers more possible configurations of driver systems and placements for additional magnets than those embodiments using dynamic drivers. While this is one advantage of balanced armature drivers over dynamic drivers, it is understood by one of ordinary skill in the art that balanced armature drivers can be much more expensive than dynamic drivers and the performance differences between these different types of drivers may not be discernible to many users so as to justify the cost premium associated with balanced armature drivers.

Figure 5A:
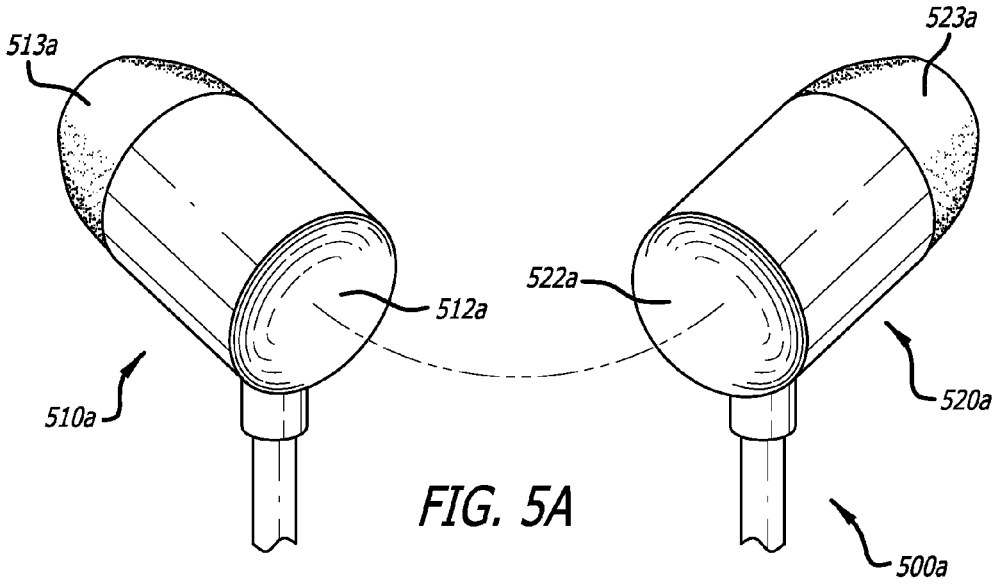
FIGS. 5A-5D illustrate examples of earpieces of in-ear headphones in accordance with various embodiments.

The embodiments of FIG. 1A, FIG. 1B, FIG. 2, FIG. 3, and FIG. 4 each depict examples configured with speaker housing structures having back surfaces that are respectively concave and convex. It will be appreciated, however, that various combinations of asymmetric, complementary surfaces can be used for in-ear headphones. For example, FIGS. 5A-5D illustrate several examples of housing structures that use different combinations of asymmetric, complementary back surfaces in accordance with alternative embodiments. In the embodiment of FIG. 5A, earpieces 510*a* and 510*b* of ear buds 500*a* are shown. The earpieces 510*a* and 510*b* respectively comprise front surfaces 513*a* and 513*b* that are intended to be positioned in the user's ears when the speakers are in operation, and back surfaces 512*a* and 522*a* that are capable of being coupled by a user when the earpieces are not located in the user's ears. The face of right back surface 522*a* is covered by uniform, circular ridges. The left back surface 512*a* comprises uniform, annular grooves cut out of its face. The uniform, annular ridges of right back surface 522*a* are complementary to the uniform, circular grooves of left back surface 512*a* such that when the back surfaces are mated, there is little to no gap between the back surfaces. Although not shown in FIG. 5A, a configuration of magnets inside the earpieces can maintain the connection between the respective back surfaces when they are coupled. In various embodiments, the ridges and grooves form a pattern to constrain the earpieces according to one orientation when the two earpieces are mated. In alternative embodiments, different numbers, patterns, widths, and respective heights and depths of ridges and grooves are contemplated.

Figure 5B:
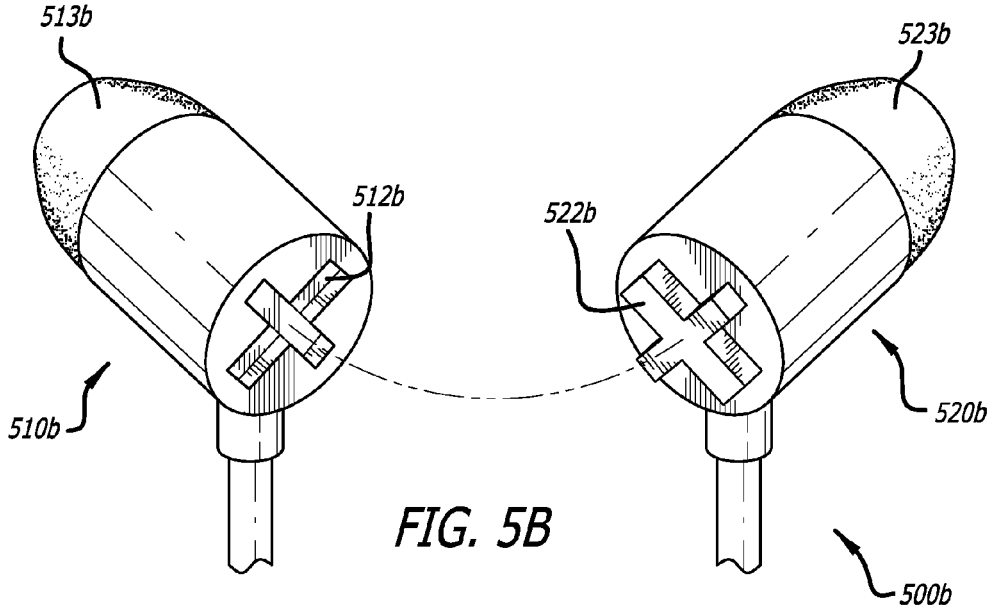

In the embodiment of FIG. 5B, earbuds 500*b* is shown having a left speaker housing 510*b* with front surface 513*b* and back surface 512*b* and a right speaker housing 520*b* with front surface 523*b* and back surface 522*b*. In this example, the face of right back surface 520*b* incorporates a cross that is slightly raised in relief from the rest of the face. The face of left back surface is configured with a complementary cross "carved" out of the left back face or in counter-relief to the left back face. In an alternative embodiment, one edge of the respective complementary crosses may be thicker than the other to limit the earbuds 500*b* to one orientation when the earpieces are mated. In various embodiments, different complementary patterns in relief and counter-relief can be used for providing asymmetrical, complementary back faces to respective earpieces. For example, the pattern of one earpiece may comprise a greater than or equal symbol "≥" in relief and the other earpiece may comprise a less than or equal symbol "≤" in counter-relief. It will be appreciated that any pattern that is substantially in relief and a complementary pattern that is substantially in counter-relief can be used in alternative embodiments.

Figure 5C:
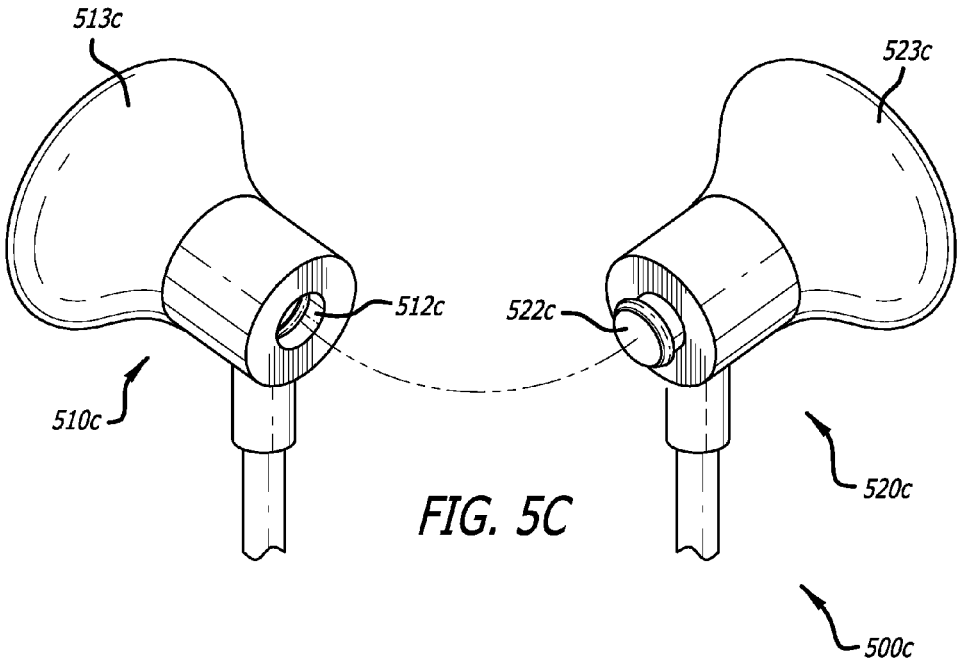

FIG. 5C illustrates another embodiment of a set of ear buds 500*c* with a left housing 510*c* and a right housing 520*c*. Each of left housing 510*c* and right housing 520*c* respectively has a front surface 513*c* and 523*c* that is intended to be positioned in a user's ear when a speaker is in operation and an asymmetrical, complementary back surface 512*c* and 522*c* that can be mated. In the example of ear buds 500*c*, right back surface 522*c* is designed with a protuberance at the center of the face. Left back surface 512*c* is configured with a recess or dimple that is complementary to the protuberance of right back surface 522*c* such that when right back surface 512*c* and left back surface 522*c* are mated, there is little to no gap between the respective back surfaces. In alternative embodiments, different numbers of protuberances or bumps, different sizes of bumps, and patterns of bumps can be used for one back surface and a complementary number of depressions or dimples, sizes of dimples, and patterns of dimples can be used for the other back surface.

Figure 5D:
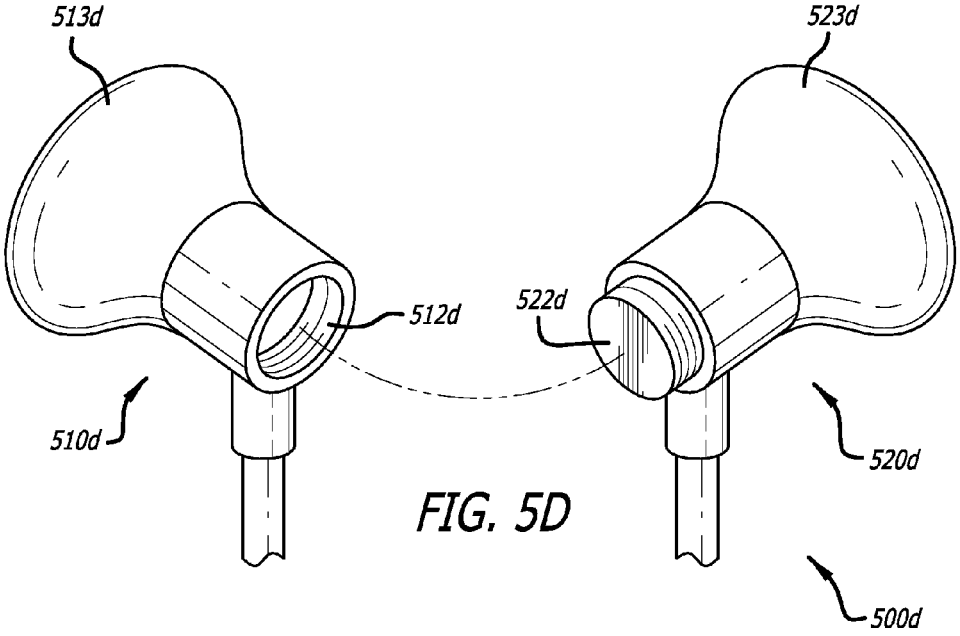

FIG. 5D illustrates yet another embodiment of a set of ear buds 500*d*. In this example, ear buds 500*d* comprises a left housing 510*d* having a front surface 513*d* and a back surface 512*d* and a right housing 520*d* with front surface 523*d* and back surface 522*d*. In this example, the right back surface 522*d* comprises a closed cylinder rising from the center of the surface face. Left back surface 512*d* comprises an open cylinder rising from the surface face that is complementary to the closed cylinder of right back surface 522*d*. In alternative embodiments, various raised geometries and complementary sunken geometries can be used, such as pyramids, pointed cones, cones with circular tops, diamonds, etc.

Although various embodiments rely upon a magnetic connection to interlock the respective back surfaces of two speaker housings, it will be understood by those of ordinary skill in the art that other mechanisms can be utilized to provide for the coupling. In one example, the interlocking can be formed by a thread fastening mechanism. A right housing may comprise threading encircling the back surface. A left housing may be a complementary configuration having a short sheath or sleeve with a smooth outer surface and a threaded inner surface that is complementary to the threading of the right housing. Such a configuration may enable the user to couple the in-ear headphones by screwing the right housing into the left housing. In another example, a snap fastening mechanism can be used to couple a left housing and a right housing. A back face of the left housing may be in a configuration of a grommet or socket and the back face of the right housing may be in the shape of a stud or snap fastener. A coupling can be achieved by a user snapping the right face into the left face. In yet another example, a hook-and-loop fastening mechanism such as Velcro™ or a variation thereof can be used to provide the asymmetrical, complementary interlocking. Each of these non-magnetic mechanical couplings—threaded fastening, snap fastening, and hook-and-loop fastening have certain advantages and disadvantages over magnetic interlocking. For example, these non-magnetic approaches may not need to be designed to take into account for magnetic interference with speaker drivers. However, these non-magnetic approaches may not be as advantageous as a configuration relying on a magnetic connection because non-magnetic approaches can be more susceptible to wear and tear. In addition, non-magnetic designs may not be able to force a single alignment for earpieces as can be achieved with magnetic designs.

Figure 6:
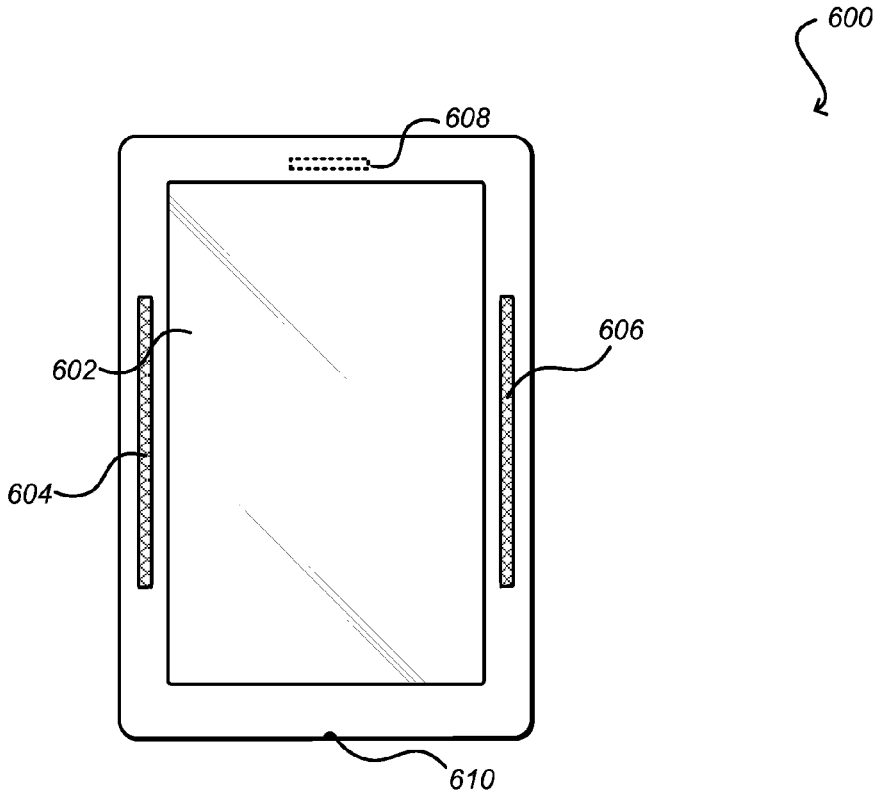
FIG. 6 illustrates an example device that can be used in accordance with various embodiments.

FIG. 6 illustrates an example of a computing device 600 that can be used in accordance with various embodiments. Although a portable computing device (e.g., a smart phone, tablet computer, or e-book reader) is shown, it will be appreciated that any device capable of receiving and processing input audio and outputting audio can be used in accordance with various embodiments discussed herein. The devices can include, for example, desktop computers, notebook computers, electronic book readers, personal data assistants, cellular phones, video gaming consoles, televisions, DVD players, set top boxes, stereo systems, portable media players, studio equipment, electronic musical instruments, and turntables, among others.

In this example, the computing device 600 has a display screen 602, which under normal operation will display information to a user facing the display screen (e.g., on the same side of the computing device as the display screen). The computing device in this example can include one or more audio output elements, in this example a left speaker 604 and a right speaker 606 each located on the face of the computing device 600, although it will be appreciated that audio output elements could also, or alternatively, be placed on the top and bottom of the face of the device or the sides or back of the device, and that there can be any appropriate number of audio output elements of similar or different types. The computing device 600 can also include at least one microphone 608 or other audio capture element(s) capable of capturing other types of input data, as known in the art. In this example, the computing device 600 also includes a port 610 for an audio jack as described in FIG. 2 above. Various other types of input can be utilized as well as known in the art for use with such devices.

Figure 7:
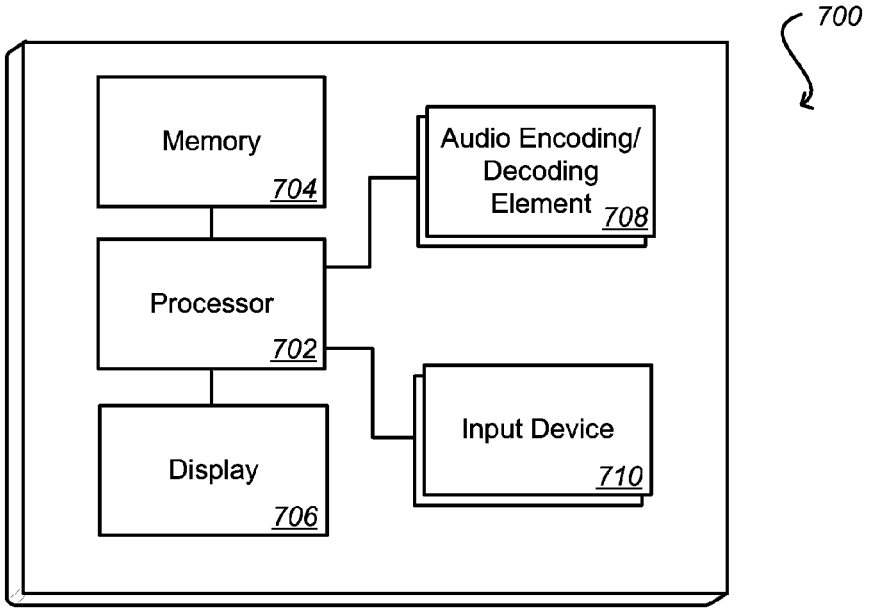
FIG. 7 illustrates an example configuration of components of a device such as that described with respect to FIG. 6.

FIG. 7 illustrates a set of basic components of a computing device 700 such as the device 600 described with respect to FIG. 6. In this example, the device includes at least one processor 702 for executing instructions that can be stored in a memory device or element 704. As would be apparent to one of ordinary skill in the art, the device can include many types of memory, data storage or computer-readable media, such as a first data storage for program instructions for execution by the processor 702, the same or separate storage can be used for audio or data, a removable memory can be available for sharing information with other devices, and any number of communication approaches can be available for sharing with other devices. The device typically will include some type of display element 706, such as a touch screen, electronic ink (e-ink), organic light emitting diode (OLED) or liquid crystal display (LCD), although devices such as portable media players might convey information via other means, such as through audio speakers. The device in many embodiments will include at least one audio encoding and decoding element or codec 708 (also referred to as a sound card). In this example, the audio codec element 708 is connected to the processor 702 through an interface for audio data communication. An audio codec element may comprise one or more digital-to-analog (DAC) converters to convert digital audio data into analog audio signals for outputting to stereo headphone, stereo speaker, earpiece, and/or stereo line outputs. An audio codec element may also include one or more analog-to-digital (ADC) converters to convert analog audio signals from one or more microphone inputs or a stereo line-input into digital data that can be stored in memory 704. Methods for converting digital data to an analog signal and converting an analog signal to digital data using an audio encoding and decoding element with a computing device are well known in the art and will not be discussed herein in detail. In the example of computing device 700, the audio codec 708 also supports accessory plug and unplug detection as well as accessory button press detection, such as for detecting signals from control elements 232, 234, and 236 of FIG. 2.

The computing device can also include at least one additional input device 710 able to receive conventional input from a user. This conventional input can include, for example, a push button, touch pad, touch screen, wheel, joystick, keyboard, mouse, trackball, keypad or any other such device or element whereby a user can input a command to the device. These I/O devices could even be connected by a wireless infrared or Bluetooth or other link as well in some embodiments. In some embodiments, however, such a device might not include any buttons at all and might be controlled only through a combination of visual and audio commands such that a user can control the device without having to be in contact with the device.

The various embodiments can be further implemented in a wide variety of operating environments, which in some cases can include one or more user computers or computing devices which can be used to operate any of a number of applications. User or client devices can include any of a number of general purpose personal computers, such as desktop or laptop computers running a standard operating system, as well as cellular, wireless and handheld devices running mobile software and capable of supporting a number of networking and messaging protocols. Such a system can also include a number of workstations running any of a variety of commercially-available operating systems and other known applications for purposes such as development and database management. These devices can also include other electronic devices, such as dummy terminals, thin-clients, gaming systems and other devices capable of communicating via a network.

The specification and drawings are to be regarded in an illustrative rather than a restrictive sense. It will, however, be evident that various modifications and changes may be made thereunto without departing from the broader spirit and scope of the invention as set forth in the claims.

What is claimed is:

1. A set of headphones, comprising:

a first earpiece having a first back surface, the first back surface comprising a first shape;

a second earpiece having a second back surface, the second back surface comprising a second shape that is asymmetrical and complementary with respect to the first shape of the first back surface;

a pair of audio drivers each located respectively within the first earpiece and the second earpiece;

a pair of magnets each respectively located within the first earpiece and the second earpiece, the pair of magnets arranged to form a magnetic connection between the first back surface and the second back surface when the first back surface and the second back surface are coupled; and a pair of speaker cords each respectively connected to the pair of audio drivers at one end and each respectively connected together at another end, wherein the pair of speaker cords form a loop when the first back surface and the second back surface are coupled.

2. The set headphones of claim 1, wherein:

the pair of magnets are arranged to constrain the first earpiece and the second earpiece to a finite number of orientations when coupled.

3. The set headphones of claim 1, wherein:

the first back surface is concave; and the second back surface is convex.

4. A device for providing audio, comprising:

a first earpiece having a first back surface;

a second earpiece having a second back surface, the second back surface being asymmetrical and complementary with respect to the first back surface, the second earpiece and the first earpiece forming a connection when the first back surface and the second back surface are coupled; and a pair of audio drivers each respectively located within the first earpiece and the second earpiece.

5. The device of claim 4, wherein the connection comprises a magnetic connection.

6. The device of claim 5, further comprising:

at least one magnet located within one of the first earpiece or the second earpiece to form the magnetic connection.

7. The device of claim 5, wherein:

one or more magnets inside each of the pair of audio drivers are configured to form the magnetic connection.

8. The device of claim 4, further comprising:

at least one of a threaded fastening mechanism, a snap fastening mechanism, or a hook-and-loop fastening mechanism to form the connection when the first back surface and the second back surface are coupled.

9. The device of claim 4, further comprising:

a pair of speaker cords each respectively connected to the pair of audio drivers at one end and each respectively connected together at another end, wherein the pair of speaker cords form a loop when the first back surface and the second back surface are coupled.

10. The device of claim 4, wherein:

the first back surface and the second back surface are configured to constrain the first earpiece and the second earpiece to a finite number of orientations when the first earpiece and the second earpiece are coupled.

11. The device of claim 10, further comprising:

a pair of speaker cord casings each respectively connected to the first earpiece and the second earpiece, wherein the pair of speaker cord casings are substantially parallel when the first earpiece and the second earpiece are coupled.

12. The device of claim 4, wherein:

the first back surface is one of a surface that is convex, the surface with one or more ridges, the surface with one or more protuberances, the surface with a pattern in relief, or the surface having a raised geometry; and the second back surface is respectively one of the surface that is concave, the surface with one or more complementary grooves, the surface with one or more complementary dimples, the surface with the pattern in counter-relief, or the surface having a complementary sunken geometry.

13. The device of claim 4, wherein each of the pair of audio drivers comprises one of:

a dynamic driver;

a balanced armature driver;

a first crossover network and a plurality of balanced armature drivers; or a second crossover network, one dynamic driver, and one or more balanced armature drivers.

14. The device of claim 4, further comprising one or more microphones.

15. The device of claim 4, further comprising:

one or more control elements for enabling control of an audio output device connected to the device.

16. The device of claim 4, wherein:

at least one of coupling or decoupling the first earpiece and the second earpiece sends one or more control signals to an audio output device connected to the device.

17. The device of claim 4, further comprising:

one or more wireless connectivity devices enabling the pair of audio drivers to be connected to an audio output device.

18. An earpiece, comprising:

a housing having a first back surface that is asymmetrical and complementary with respect to a second hack surface of a second earpiece, the first back surface and the second back surface forming a connection when the first back surface and the second back surface are coupled; and an audio driver located within the first housing.

19. The earpiece of claim 18, wherein the connection comprises a magnetic connection.

20. The earpiece of claim 19, further comprising:

at least one magnet located within the first housing to form at least in part the magnetic connection.

21. The earpiece of claim 19, wherein:

one or more magnets inside the audio driver is configured to form at least in part the magnetic connection.

22. The earpiece of claim 18, further comprising:

at least one of a thread fastening mechanism, a snap fastening mechanism, or a hook-and-loop fastening mechanism to form the connection at least in part when the first back surface and the second back surface are coupled.

23. The earpiece of claim 18, wherein:

the first back surface and the second back surface are configured to constrain the housing and the second earpiece to a finite number of orientations when coupled.

24. The earpiece of claim 18, wherein:

the first back surface is one of a surface that is convex, the surface with one or more ridges, the surface with one or more protuberances, the surface with a pattern in relief, the surface having a raised geometry, the surface that is concave, the surface with one or more grooves, the surface with one or more dimples, the surface with the pattern in counter-relief, or the surface having a sunken geometry.

25. The earpiece of claim 18, wherein the audio driver comprises one of:

a dynamic driver;

a balanced armature driver;

a first crossover network and a plurality of balanced armature drivers; or a second crossover network, one dynamic driver, and one or more balanced armature drivers.

* * * * *